United States Patent [19]

Gomi et al.

[11] 4,434,319

[45] Feb. 28, 1984

[54] POF CABLE HAVING OUTER PIPE WITH CURVED OFFSET SECTIONS TO ACCOMMODATE EXPANSION OF THE CORE

[75] Inventors: Yoshiaki Gomi, Kasugai; Takahiro Hirata, Gifu; Michio Takaoka, Chiba; Tsuneaki Mohtai, Yachiyo; Kazuya Akashi, Tokyo, all of Japan

[73] Assignees: The Chuba Electric Power Company Inc., Nagoya; The Fujikura Cable Works, Ltd., Tokyo, both of Japan

[21] Appl. No.: 298,160

[22] Filed: Aug. 31, 1981

[30] Foreign Application Priority Data

Sep. 5, 1980 [JP] Japan ..... 55-123273
Sep. 5, 1980 [JP] Japan ..... 55-123274

[51] Int. Cl.[3] ..... H01B 9/06
[52] U.S. Cl. ..... 174/13; 174/24
[58] Field of Search ..... 174/13, 24, 25 R, 26 R, 174/37; 405/154

[56] References Cited

FOREIGN PATENT DOCUMENTS

| | | | |
|---|---|---|---|
| 706969 | 3/1965 | Canada | 174/13 |
| 44-25502 | 10/1969 | Japan | 174/37 |
| 44-32698 | 12/1969 | Japan | 405/154 |
| 689013 | 3/1953 | United Kingdom | 174/24 |

*Primary Examiner*—Laramie E. Askin
*Attorney, Agent, or Firm*—Schwartz, Jeffery, Schwaab, Mack, Blumenthal & Koch

[57] ABSTRACT

A POF cable line which comprises a steel pipe and three cable cores drawn in the steel pipe. At least one curved offset section is arranged on the steel pipe at a part spaced from a cable joint at a predetermined distance, with a straight portion of the steel pipe interposed therebetween. The curved offset section prevents the cable cores in the part of the steel pipe from snaking hard and consequently prevents the insulation paper in the part from making soft spots or creases. The snaking occurs easily in the offset section when the cable core thermally expands.

9 Claims, 8 Drawing Figures

POF CABLE HAVING OUTER PIPE WITH CURVED OFFSET SECTIONS TO ACCOMMODATE EXPANSION OF THE CORE

BACKGROUND OF THE INVENTION

This invention relates to a pipe-type oil-filled (hereinafter referred to as POF) cable line for an electric power transmission system, and more particularly to a POF cable core whose longitudinal thermal expansion can be easily absorbed.

The POF cable generally comprises cable cores 2 and joints 3 connecting the cable cores 2 together in a steel pipe 1 as shown in FIG. 1. The POF cable described above is conventionally installed in a straight line, except for the case making a detour of obstructions lying in the cable-laying route. The longitudinal thermal expansion of the cable core 2 when supplied with electrical load is conventionally absorbed by the snakelike bending 4 of the cable core 2, that is, the cable snaking, which occurs in a relatively broad space between the steel pipe 1 and the cable core 2. (The steel pipe has an inner diameter approximately 2.7 times larger than the outer diameter of the cable core 2.).

Generally the cable snaking 4 of the cable core 2 tends to occur near the cable joint 3 and the thermal expansion of the cable core tends to concentrate at the cable snaking area. Consequently the curvature radius of the cable snaking 4 becomes small and repeated thermal bending will create soft spots and creases in insulation papers, in the case of the paper-insulated cable. And in some extreme cases, such bending will lead to dielectric breakdown.

SUMMARY OF THE INVENTION

This invention has been accomplished to resolve the above-mentioned defects, and is intended to provide a POF cable line which includes at least one curved offset section at any part of a steel pipe of the POF cable line. Having the cable core 2 already bent slightly in the curved offset section causes the cable snaking to occur more easily there than the cable core 2 in the straight pipe, when the POF cable line is in operation.

To attain the above-mentioned object, this invention provides a POF cable line which comprises a steel pipe and a cable core drawn into the steel pipe, and wherein more than one curved offset section of the steel pipe is provided at any part of the steel pipe constituting the POF cable line.

DETAILED DESCRIPTION OF THE PREFERRED EMBODIMENTS

Figure 1:
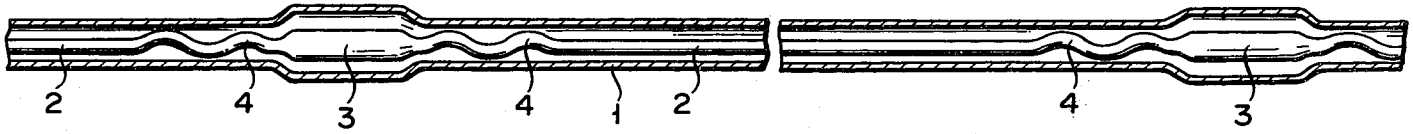
FIG. 1 illustrates, in a horizontal plane, the arrangement of the conventional POF cable line.
Figure 2:
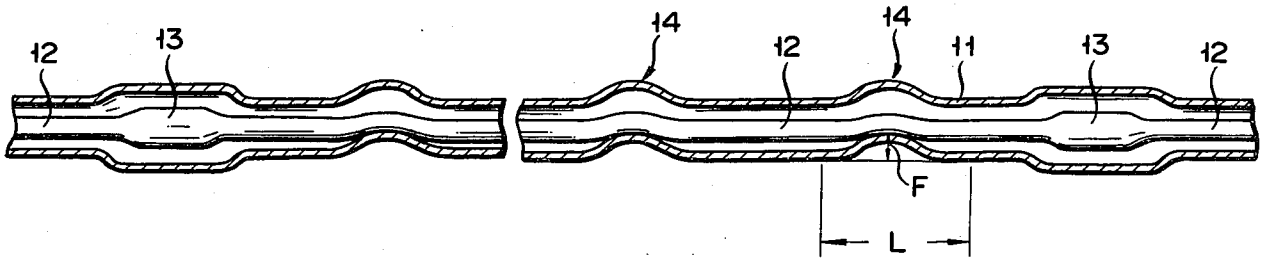
FIG. 2 indicates, in a longitudinal plane, the arrangement of a POF cable according to one embodiment of this invention.

Description is now given by reference to FIG. 2 of a POF cable line according to one embodiment of this invention.

Reference numeral 11 is a steel pipe. Reference numeral 12 represents, for example, a 275 KV, 2500 $mm^2$ paper-insulated power cable core comprising a cable conductor (only one cable core is typically shown for briefness of representation in every figure, though the POF cable line is normally formed of three cable cores), which is inserted into the steel pipe 11. Reference numeral 13 is a cable joint for connecting together the cable cores 12. The cable joint is provided at an interval predetermined by conditions such as cable-laying route and so forth. Further, the steel pipe 11 is filled with insulation oil. Reference numeral 14 denotes curved offset sections of the steel pipe 11 having, for example, a curvature radius of approximately 30 meters, at least one of which is arranged in the straight steel pipe of the cable line. The position of the curved offset section 14 need not be limited to that indicated in FIG. 2. Namely, said offset section 14 may be positioned along any part of the steel pipe 11. FIG. 2 indicates an offset section 14 which is within a vertical plane with respect to the ground surface. The offset section 14 is shown in every figure in the vertical plane to the ground surface. However, the invention is not limited to this arrangement. Namely, the curved offset section may be within the horizontal plane, for example. The curved offset section may also be arranged in any plane between vertical and horizontal planes. In other words, the curved offset section may be arranged in any two dimensional plane. It is also possible to provide a cable with the offset sections arranged in various different planes. Further, the offset section may have a segmental, sine wave or parabolic form. In other words, the offset section may take any form, as described above, provided it is defined by a smooth and continuous curve. The form of the offset section need not be limited to that which is illustrated in the above embodiment, but may be defined by S-bent waveform. Further, a plurality of offset sections may be continuously arranged on the steel pipe 11. The number of offset sections 14 arranged in a manhole-to-manhole interval or joint-to-joint interval, the distance of the adjacent offset sections, the length of each offset section and the offset width F (indicated in FIG. 2) are determined in consideration of the anticipated expansion and contraction of the cable core 12.

Description is now given with reference to the accompanying drawings of a POF cable line embodying this invention. Unlike offset sections provided for a general cable line, the offset section 14 arranged on the steel pipe 11 embodying the invention is not intended to absorb the expansion of the steel pipe itself, but is intended to cause the cable core 12 to snake easily in the curved offset section 14. The steel pipe 11 of the POF cable line has sufficient internal space to allow a cable core to snake (the inner diameter of the steel pipe 11 is approximately 2.7 times larger than the outer diameter of the cable core 12). Therefore, the offset section 14 used in this invention need not have an extremely small curvature.

Figure 3:
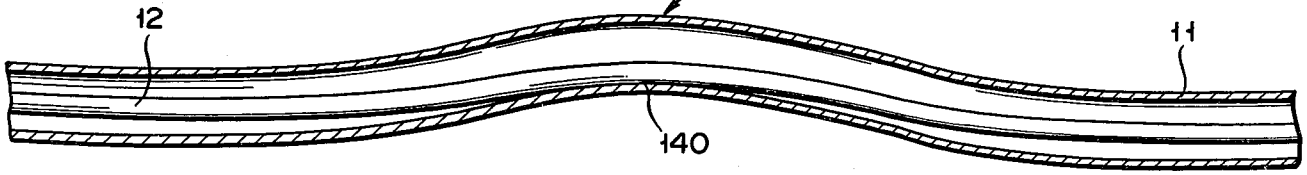
FIGS. 3 to 5 set forth the state in which the cable core in the steel pipe of FIG. 2 is snaking.
Figure 4:
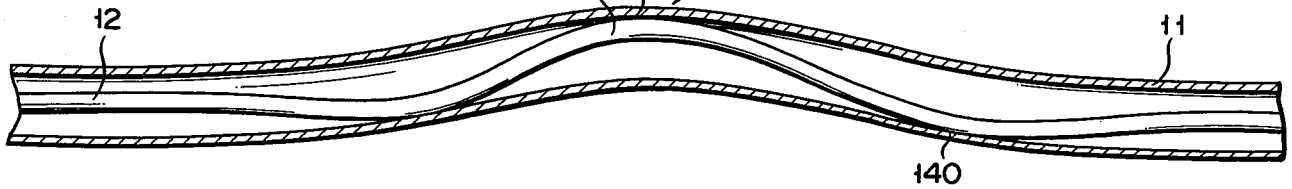
Figure 5:
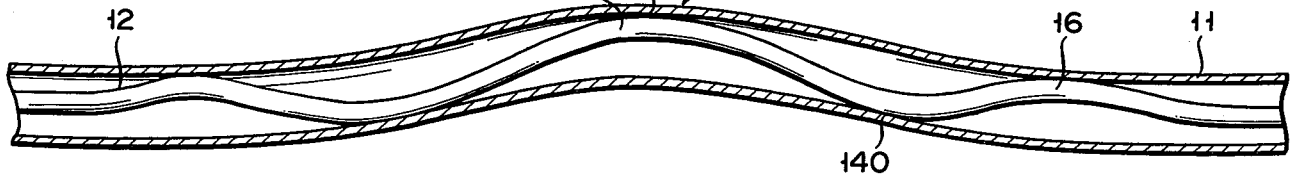

Description is now given with reference to FIGS. 3 to 5 of the state in which the cable core 12 of a POF cable line embodying this invention snakes due to longitudinal thermal expansion.

(1) For example, when the cable core 12 is not electrically loaded, that is, is not longitudinally thermally expanded, then the cable core 12 is only slightly bent due to its bending in the offset section 14 and may touch the inner side wall 140 of the offset section 14.

(2) The slightly bent portion of the unloaded cable core 12 in the offset section 14 tends to move easily as soon as the cable core 12 longitudinally thermally expands when electrically loaded, thereby providing a first cable snaking 15. The cable core 12 moves as shown in FIG. 4 towards the other side of the pipe 11 until the cable core 12 touches the inner surface 142 of the steel pipe 11.

(3) When the thermal expansion of the cable core 12 is not fully absorbed in the offset section 14, a second cable snaking 16 may occur at both sides near the offset section 14 of the cable core 12 as shown in FIG. 5 in order to absorb the thermal expansion.

With a POF cable line embodying this invention, the longitudinal thermal expansion of the cable core 12 is absorbed, to begin with, by its first cable snaking 15 in the offset section 14 arranged on the steel pipe 11. The thermal expansion of the cable core 12 which is not fully absorbed by the first cable snaking 15 can be absorbed by producing the second cable snaking 16 at both sides of the offset section 14. Therefore, the phenomenon of the concentration of the cable expansion at one spot near the cable joint 13, as is the case with the conventional POF cable line, is avoided, thereby preventing the occurrence of creases or soft spots of insulation paper.

Figure 6:
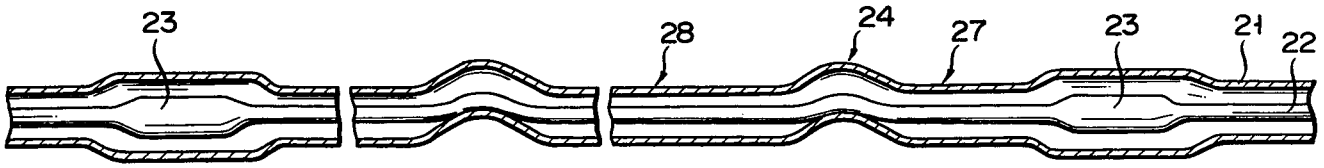
FIG. 6 shows, in a horizontal plane, the arrangement of a POF cable according to another embodiment of the invention.

Description is now given with reference to FIG. 6 of a POF cable line according to another embodiment of this invention. Reference numeral 21 is a steel pipe. Reference numeral 22 represents, for example, a 275 KV, 2500 $mm^2$ paper-insulated power cable core comprising a cable conductor (as in the FIG. 2 embodiment, only one cable core is typically shown for briefness of representation in every figure, though the POF cable line is normally formed of three cable cores), which is put in the steel pipe 21. Reference numeral 23 is a cable joint for connecting adjacent cable cores 22. The steel pipe 21 is filled with insulation oil. Reference numeral 27 shows a straight portion of the steel pipe 21 which lies near the cable joint 23, and reference numeral 24 is an offset section near the cable joint 23. Reference numeral 28 represents a straight portion of the steel pipe 21. Straight portions 27 and 28 are arranged on the opposite sides of a curved offset section 24. The curved offset section 24 is arranged with a curvature radius of approximately 30 meters, for example, and is within the horizontal plane.

In this case, it is preferred that the curved offset section 24 be positioned as near as possible to the cable joint 23. The straight portion 27 of the steel pipe 21 should have such length as is required to let that portion of the cable core 22 which extends between the offset section 24 and cable joint 23 have a prescribed linear length in which snaking is suppressed.

Where, in the embodiment of FIG. 6, the adjacent cable joints 23 are spaced from each other at a great distance, then the longitudinal thermal expansion of the cable core 22 can be effectively absorbed by arranging one or more offset sections 24 at any position between the adjacent cable joints 23. The form of the curved offset section 24 used in the embodiment of FIG. 6 need not be limited to that indicated therein.

Figure 7:
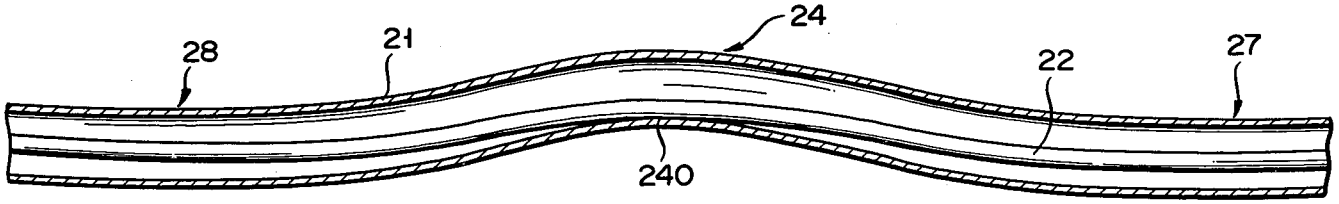
FIGS. 7 and 8 illustrate the manner in which the cable core in a steel pipe of FIG. 6 is snaking.
Figure 8:
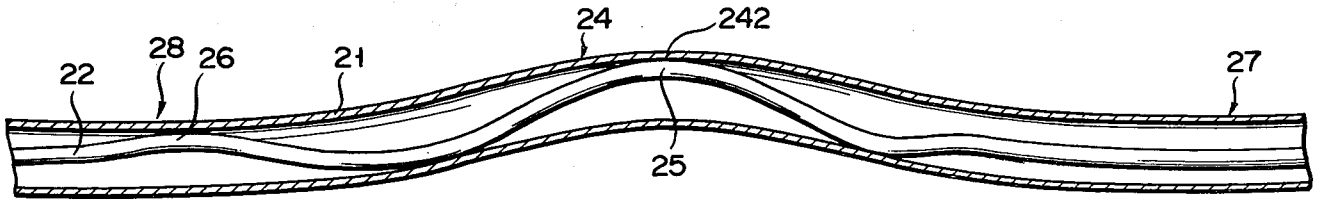

Description is now given with reference to FIGS. 7 and 8 of the manner in which the loaded cable core 22 snakes to absorb its longitudinal thermal expansion, where the curved offset section 24 is arranged on the steel pipe 21 and spaced from the cable joint 23 at a prescribed distance at a position defined between the straight portions 27 set adjacent to the cable joint 23.

(1) When unloaded, the cable core 22 touches, as shown in FIG. 7, the inner wall 240 of the offset section 24 of the steel pipe 21 in a slightly bent state.

(2) When longitudinally expanded due to temperature rise of the cable conductor, the cable core 22 which is already slightly bent when unloaded is prominently bent towards the other side of the wall 240, as shown in FIG. 8, by expanding from the side of the straight section 28 of the steel pipe 21, thereby resulting in cable snaking 25. As a result, the expansion of the cable core 22 is absorbed at the first cable snaking 25.

(3) When the cable core 22 further expands to reach the portion 242 of the inner wall of the offset section, then a second cable snaking 26 occurs adjacent to the first cable snaking 25, more particularly, near the boundary between the offset section 24 and the straight section 27 of the steel pipe 21.

The cable joint 23 is spaced from the offset section 24 at a small distance. Therefore, that portion of the cable core 22 which corresponds to said distance is longitudinally thermally expanded slightly, since the longitudinally thermally expanded section of the cable core 22 is pressed against the inner wall portion 242 of the offset section 24. Therefore, the expansion of the cable core 22 toward the cable joint 23 is restricted. Moreover, the straight portion 27 of the steel pipe 21 is provided adjacent to the cable joint 23. Therefore, a second cable snaking does not occur substantially in the portion of the cable core 22 which faces the straight portion 27 of the steel pipe 21. Even if the cable snaking occurs, the second cable snaking is little. The above-mentioned arrangement of the embodiment of FIG. 6 is intended to protect the cable joint 23 from damage by rendering the portion of the cable core 22 which is near the cable joint 23 as straight as possible. This is the reason why the steel pipe 2 of the POF cable line of the embodiment of FIG. 6 is provided with straight portions 27. If made 4 meters long, for example, the straight portion 27 sufficiently serves the purpose. The embodiment of FIG. 6 has the advantages that the curved offset section 24 enables the cable core 22 to snake easily, thereby absorbing the longitudinal thermal expansion of the cable core 22, and that the straight portion 27 of the steel pipe 21 suppresses the effect of the snaking of the cable core 22 on the cable joint 23. If, in this case, the curved offset section 24 is allowed to have a sufficiently large curvature radius, then the resultant snaking portion of the cable core 22 can also have a sufficiently large curvature radius. This invention prevents a plurality of snaking portions having a small curvature radius from occurring in a concentrated manner at a particular spot, for example, near the cable joint, as is the case with the conventional POF cable line, thereby avoiding the soft spots, creases, and tears of insulation papers and consequent dielectric breakdown.

What we claim is:

1. A POF cable line comprising:

a pipe having a generally constant diameter and containing insulating oil therein;

a cable core within the pipe, said core lying substantially straight in the pipe when the cable line is electrically unloaded, said pipe having at least one curved offset section having a diameter substantially the same as said first mentioned diameter and positioned along the pipe to accommodate longitudinal thermal expansion of said cable core by providing controlled snaking of said cable core with respect to said pipe, said pipe having an inner diameter sufficiently larger than an outer diameter of the cable core to permit said at least one curved offset section to accommodate said longitudinal thermal expansion.

2. The POF cable line of claim 1, wherein the POF cable line further includes at least one cable joint, said at least one curved offset section being positioned at a location spaced a predetermined distance from said at least one cable joint, whereby a straight portion of said pipe is interposed between said cable joint and curved offset section.

3. The POF cable line of claim 2, wherein said at least one curved offset section comprises a plurality of offset sections and said at least one cable joint comprises a plurality of cable joints whereby straight portions of said pipe are interposed between each of said joints and offset sections.

4. A POF cable line according to claim 3, wherein each of the curved offset sections has a smooth and continuous curvature.

5. A POF cable line according to claim 3, wherein the curved offset sections are located in a horizontal plane.

6. A POF cable line according to claim 3, wherein the curved offset sections are located in a vertical plane.

7. A POF cable line according to claim 3, wherein at least one of the curved offset sections is located within a horizontal plane and at least one of the curved offset sections is located within a vertical plane.

8. A POF cable line according to claim 3, wherein at least one of said curved offset sections is located in a plane defined between a horizontal and vertical plane.

9. A POF cable line having at least one joint, said cable line comprising:

an elongated, insulated cable core having an outer diameter;

an elongated sheath containing insulating oil surrounding said cable core, said sheath being in the form of a pipe having a generally constant diameter, the cable core being maintained substantially straight in the pipe when the cable line is electrically unloaded;

means for accommodating longitudinal thermal expansion of said cable core with respect to said pipe by providing for controlled snaking of said cable core with respect to said pipe at locations spaced from said joint area to thereby prevent expansion induced defects in the insulation, said means for accommodating longitudinal thermal expansion including at least one curved offset section formed in said pipe at a location where said section is not otherwise required for directing the cable line along its desired route, said offset portion of said pipe having substantially the same diameter as said generally constant pipe diameter, and said pipe having an inner diameter which is approximately 2.7 times larger than said outer diameter of said cable core for accommodating said controlled snaking.

* * * * *